US012163286B2

(12) United States Patent
Miller, IV et al.

(10) Patent No.: US 12,163,286 B2
(45) Date of Patent: Dec. 10, 2024

(54) SYSTEMS AND METHODS FOR CLEANING COMPOSITE LAMINATED IMPRINTING FABRICS

(71) Applicant: First Quality Tissue, LLC, Great Neck, NY (US)

(72) Inventors: Byrd Tyler Miller, IV, Easley, SC (US); Marc Paul Begin, Simpsonville, SC (US); Theodore D. Kennedy, San Mateo, FL (US)

(73) Assignee: FIRST QUALITY TISSUE, LLC, Great Neck, NY (US)

( * ) Notice: Subject to any disclaimer, the term of this patent is extended or adjusted under 35 U.S.C. 154(b) by 0 days.

(21) Appl. No.: 17/969,039

(22) Filed: Oct. 19, 2022

(65) Prior Publication Data

US 2023/0122186 A1 Apr. 20, 2023

Related U.S. Application Data

(60) Provisional application No. 63/257,184, filed on Oct. 19, 2021.

(51) Int. Cl.
*D21F 1/32* (2006.01)
*D21F 7/12* (2006.01)

(52) U.S. Cl.
CPC . *D21F 1/32* (2013.01); *D21F 7/12* (2013.01)

(58) Field of Classification Search
CPC ..... D21F 1/32; D21F 1/00; D21F 7/08; D21F 1/66; D21F 11/00; D21F 11/14; D21F 3/02; D21F 5/18; D21F 9/00
See application file for complete search history.

(56) References Cited

U.S. PATENT DOCUMENTS

| | | | | |
|---|---|---|---|---|
| 3,143,150 | A | 8/1964 | Buchanan | |
| 3,171,776 | A * | 3/1965 | Hart | D21F 3/10 384/510 |
| 3,473,576 | A | 10/1969 | Amneus | |
| 3,573,164 | A | 3/1971 | Friedberg et al. | |
| 3,905,863 | A | 9/1975 | Ayers | |
| 3,974,025 | A | 8/1976 | Ayers | |
| 3,994,771 | A | 11/1976 | Morgan, Jr. et al. | |
| 4,102,737 | A | 7/1978 | Morton | |

(Continued)

FOREIGN PATENT DOCUMENTS

| | | | |
|---|---|---|---|
| EP | 1339915 | B1 | 7/2007 |
| WO | 2009061079 | A1 | 5/2009 |
| WO | 2009067079 | A1 | 5/2009 |

OTHER PUBLICATIONS

International Search Report Issued in Application No. PCT/US2022/047096, dated Feb. 14, 2023.

*Primary Examiner* — Jacob T Minskey
*Assistant Examiner* — Matthew M Eslami
(74) *Attorney, Agent, or Firm* — Amster, Rothstein & Ebenstein LLP

(57) ABSTRACT

A system and method of cleaning an imprinting fabric used to make bath tissue, paper towel, or facial tissue, in which the imprinting fabric is washed with water from high pressure impact showers and flooding showers, and water remaining on the imprinting fabric after the step of washing is removed with a vacuum roll on a sheet side of the imprinting fabric. The system and method does not involve removing water from the fabric with a uhle box on the sheet side of the imprinting fabric.

9 Claims, 2 Drawing Sheets

(56) References Cited

U.S. PATENT DOCUMENTS

| | | | |
|---|---|---|---|
| 4,184,519 | A | 1/1980 | McDonald et al. |
| 4,191,609 | A | 3/1980 | Trokhan |
| 4,514,345 | A | 4/1985 | Johnson et al. |
| 4,528,239 | A | 7/1985 | Trokhan |
| 4,529,480 | A | 7/1985 | Trokhan |
| 4,637,859 | A | 1/1987 | Trokhan |
| 4,909,284 | A | 3/1990 | Kositzke |
| 5,334,289 | A | 8/1994 | Trokhan et al. |
| 5,510,002 | A | 4/1996 | Hermans et al. |
| 5,607,551 | A | 3/1997 | Farrington, Jr. et al. |
| 5,679,222 | A | 10/1997 | Rasch et al. |
| 5,806,569 | A | 9/1998 | Gulya et al. |
| 6,048,938 | A | 4/2000 | Neal et al. |
| 6,120,642 | A | 9/2000 | Lindsay et al. |
| 6,610,173 | B1 | 8/2003 | Lindsay et al. |
| 6,660,362 | B1 | 12/2003 | Lin et al. |
| 6,821,391 | B2 | 11/2004 | Scherb et al. |
| 6,878,238 | B2 | 4/2005 | Bakken et al. |
| 6,998,017 | B2 | 2/2006 | Lindsay et al. |
| 7,339,378 | B2 | 3/2008 | Han et al. |
| 7,387,706 | B2 | 6/2008 | Herman et al. |
| 7,442,278 | B2 | 10/2008 | Murray et al. |
| 7,494,563 | B2 | 2/2009 | Edwards et al. |
| 7,510,631 | B2 | 3/2009 | Scherb et al. |
| 7,582,187 | B2 | 9/2009 | Scherb et al. |
| 7,686,923 | B2 | 3/2010 | Scherb et al. |
| 7,744,726 | B2 | 6/2010 | Scherb et al. |
| 7,811,418 | B2 | 10/2010 | Klerelid et al. |
| 7,905,989 | B2 | 3/2011 | Scherb et al. |
| 7,931,781 | B2 | 4/2011 | Scherb et al. |
| 8,075,739 | B2 | 12/2011 | Scherb et al. |
| 8,092,652 | B2 | 1/2012 | Scherb et al. |
| 8,382,956 | B2 | 2/2013 | Boechat et al. |
| 8,580,083 | B2 | 11/2013 | Boechat et al. |
| 8,980,062 | B2 | 3/2015 | Karlsson et al. |
| 10,099,425 | B2 | 10/2018 | Miller, Iv et al. |
| 10,208,426 | B2 | 2/2019 | Sealey et al. |
| 10,415,185 | B2 | 9/2019 | Sealey et al. |
| 10,787,767 | B2 | 9/2020 | Sealey et al. |
| 10,815,620 | B2 | 10/2020 | Sealey et al. |
| 11,028,534 | B2 | 6/2021 | Sealey et al. |
| 2021/0017707 | A1* | 1/2021 | Sealey, II ..... D21F 1/66 |

* cited by examiner

SYSTEMS AND METHODS FOR CLEANING COMPOSITE LAMINATED IMPRINTING FABRICS

RELATED APPLICATIONS

This application claims priority to and the benefit of U.S. Provisional Patent Application No. 63/257,184, filed Oct. 19, 2021 and entitled SYSTEMS AND METHODS FOR CLEANING COMPOSITE LAMINATED IMPRINTING FABRICS, the contents of which are incorporated herein by reference in their entirety.

FIELD OF THE INVENTION

This invention relates to systems and methods for the cleaning of imprinting fabrics and in particular to the cleaning of composite laminated imprinting fabrics used to manufacture bath tissue, paper towel, or facial tissue.

BACKGROUND

Tissue (sanitary tissue, facial tissue, paper towel, and napkin) manufacturers that can deliver the highest quality product at the lowest cost have a competitive advantage in the marketplace. A key component in determining the cost and quality of a tissue product is the manufacturing process utilized to create the product. For tissue products, there are several manufacturing processes available including conventional dry crepe (CDC), conventional wet crepe (CWC), through air drying (TAD), uncreped through air drying (UCTAD) or "hybrid" technologies such as Valmet's NTT and QRT processes, Georgia Pacific's ETAD, and Voith's ATMOS process. Each has differences as to installed capital cost, raw material utilization, energy cost, production rates, and the ability to generate desired tissue attributes such as softness, strength, and absorbency.

Conventional manufacturing processes include a forming section designed to retain a fiber, chemical, and filler recipe while allowing water to drain from a web. Many types of forming sections, such as inclined suction breast roll, gap former twin wire C-wrap, gap former twin wire S-wrap, suction forming roll, and Crescent formers, include the use of forming fabrics.

Forming fabrics are woven structures that utilize monofilaments (such as yarns or threads) composed of synthetic polymers (usually polyethylene terephthalate, or nylon). A forming fabric has two surfaces, a sheet side and a machine or wear side. The wear side is in contact with the elements that support and move the fabric and are thus prone to wear. To increase wear resistance and improve drainage, the wear side of the fabric has larger diameter monofilaments compared to the sheet side. The sheet side has finer yarns to promote fiber and filler retention on the fabric surface.

Different weave patterns are utilized to control other properties such as: fabric stability, life potential, drainage, fiber support, and clean-ability. There are three basic types of forming fabrics: single layer, double layer, and triple layer. A single layer fabric is composed of one yarn system made up of cross direction (CD) yarns (also known as shute yarns or weft yarns) and machine direction (MD) yarns (also known as warp yarns). The main issue for single layer fabrics is a lack of dimensional stability. A double layer forming fabric has one layer of warp yarns and two layers of shute yarns or weft yarns. This multilayer fabric is generally more stable and resistant to stretching. Triple layer fabrics have two separate single layer fabrics bound together by separated yarns called binders. Usually the binder fibers are placed in the cross direction but can also be oriented in the machine direction. Triple layer fabrics have further increased dimensional stability, wear potential, drainage, and fiber support as compared to single or double layer fabrics.

The manufacturing of forming fabrics includes the following operations: weaving, initial heat setting, seaming, final heat setting, and finishing. The fabric is made in a loom using two interlacing sets of monofilaments (or threads or yarns). The longitudinal or machine direction threads are called warp threads and the transverse or cross machine direction threads are called shute threads. After weaving, the forming fabric is heated to relieve internal stresses, which in turn enhances dimensional stability of the fabric. The next step in manufacturing is seaming. This step converts the flat woven fabric into an endless forming fabric by joining the two MD ends of the fabric. After seaming, a final heat setting is applied to stabilize and relieve the stresses in the seam area. The final step in the manufacturing process is finishing, whereby the fabric is cut to width and sealed.

There are several parameters and tools used to characterize the properties of the forming fabric: mesh (warp count) and knock (weft count), caliper, frames, plane difference, percent open area, air permeability, tensile strength and modulus, stiffness, shear resistance, void volume and distribution, running attitude, fiber support index, drainage index, and stacking. None of these parameters can be used individually to precisely predict the performance of a forming fabric on a paper machine, but together the expected performance and sheet properties can be estimated. Examples of forming fabric designs can be viewed in U.S. Pat. Nos. 3,143,150, 4,184,519, 4,909,284, and 5,806,569.

In a CDC or CWC process, after web formation and drainage (to around 35% solids) in the forming section (assisted by centripetal force around the forming roll and, in some cases, vacuum boxes), a web is transferred from the forming fabric to a press fabric upon which the web is pressed between a rubber or polyurethane covered suction pressure roll and a steam heated cylinder referred to as the Yankee dryer. The press fabric is a permeable fabric designed to uptake water from the web as it is pressed in the press section. It is composed of large monofilaments or multi-filamentous yarns, needled with fine synthetic batt fibers to form a smooth surface for even web pressing against the Yankee dryer. Removing water via pressing reduces energy consumption compared to using heat. The web is transferred to the Yankee dryer then dried (with assistance of a hot air impingement hood) and creped from the Yankee dryer and reeled. When creped at a solids content of less than 90%, the process is referred to as Conventional Wet Crepe. When creped at a solids content of greater than 90%, the process is referred to as Conventional Dry Crepe. These processes can be further understood by reviewing Yankee Dryer and Drying, A TAPPI PRESS Anthology, pg 215-219, the contents of which are incorporated herein by reference in their entirety.

In a conventional TAD process, rather than pressing and compacting the web, as is performed in conventional dry crepe, the web undergoes the steps of imprinting and thermal pre-drying. Imprinting is a step in the process where the web is transferred from a forming fabric to a structured fabric (structuring or imprinting fabric) and subsequently pulled into the structured fabric using vacuum (referred to as imprinting or molding). This step imprints the weave pattern (or knuckle pattern) of the structured fabric into the web. This imprinting step increases softness of the web, and affects smoothness and the bulk structure. The monofilaments of the fabric are typically round in shape but can also be square or rectangular. The web contacting side of the fabric is sometimes sanded to provide higher contact area when pressing against the Yankee dryer to facilitate web transfer. The manufacturing method of an imprinting fabric is similar to a forming fabric (see U.S. Pat. Nos. 3,473,576, 3,573,164, 3,905,863, 3,974,025, and 4,191,609 for examples) except in some cases an additional step of overlaying a polymer is conducted.

Imprinting fabrics with an overlaid polymer are disclosed in U.S. Pat. Nos. 6,120,642, 5,679,222, 4,514,345, 5,334,289, 4,528,239 and 4,637,859. Specifically, these patents disclose a method of forming a fabric in which a patterned resin is applied over a woven substrate. The patterned resin completely penetrates the woven substrate. The top surface of the patterned resin is flat and openings in the resin have sides that follow a linear path as the sides approach and then penetrate the woven structure.

U.S. Pat. Nos. 6,610,173, 6,660,362, 6,878,238 and 6,998,017, and European Patent No. EP 1 339 915 disclose another technique for applying an overlaid resin to a woven imprinting fabric. According to this technique, the overlaid polymer has an asymmetrical cross sectional profile in at least one of the machine direction and a cross direction and at least one nonlinear side relative to the vertical axis. The top portion of the overlaid resin can be a variety of shapes and not simply a flat structure. The sides of the overlaid resin, as the resin approaches and then penetrates the woven structure, can also take different forms, not a simple linear path 90 degrees relative to the vertical axis of the fabric. Both methods result in a patterned resin applied over a woven substrate. The benefit is that resulting patterns are not limited by a woven structure and can be created in any desired shape to enable a higher level of control of the web structure and topography that dictate web quality properties.

Regarding the TAD process, after imprinting, the web is thermally pre-dried by moving hot air through the web while it is conveyed on the structured fabric. Thermal pre-drying can be used to dry the web to over 90% solids before the web is transferred to a steam heated cylinder. The web is then transferred from the structured fabric to the steam heated cylinder through a very low intensity nip (up to 10 times less than a conventional press nip) between a solid pressure roll and the steam heated cylinder. The portions of the web that are pressed between the pressure roll and steam cylinder rest on knuckles of the structured fabric; thereby protecting most of the web from the light compaction that occurs in this nip. The steam cylinder and an optional air cap system, for impinging hot air, then dry the sheet to up to 99% solids during the drying stage before creping occurs. The creping step of the process again only affects the knuckle sections of the web that are in contact with the steam cylinder surface. Due to only the knuckles of the web being creped, along with the dominant surface topography being generated by the structured fabric, and the higher thickness of the TAD web, the creping process has a much smaller effect on overall softness as compared to conventional dry crepe. After creping, the web is optionally calendared and reeled into a parent roll and ready for a converting process. Some TAD machines utilize fabrics (similar to dryer fabrics) to support the sheet from the crepe blade to the reel drum to aid in sheet stability and productivity. Patents which describe creped through air dried products include U.S. Pat. Nos. 3,994,771, 4,102,737, 4,529,480, and 5,510,002.

The TAD process generally has higher capital costs as compared to a conventional tissue machine due to the amount of air handling equipment needed for the TAD section. Also, the TAD process has a higher energy consumption rate due to the need to burn natural gas or other fuels for thermal pre-drying. However, the bulk softness and absorbency of a paper product made from the TAD process is superior to conventional paper due to the superior bulk generation via structured fabrics, which creates a low density, high void volume web that retains its bulk when wetted. The surface smoothness of a TAD web can approach that of a conventional tissue web. The productivity of a TAD machine is less than that of a conventional tissue machine due to the complexity of the process and the difficulty of providing a robust and stable coating package on the Yankee dryer needed for transfer and creping of a delicate pre-dried web.

UCTAD (un-creped through air drying) is a variation of the TAD process in which the sheet is not creped, but rather dried up to 99% solids using thermal drying, blown off the structured fabric (using air), and then optionally calendared and reeled. U.S. Pat. No. 5,607,551 describes an uncreped through air dried product.

A process/method and paper machine system for producing tissue has been developed by the Voith company and is marketed under the name ATMOS. The process/method and paper machine system have several variations, but all involve the use of a structured fabric in conjunction with a belt press. The major steps of the ATMOS process and its variations are stock preparation, forming, imprinting, pressing (using a belt press), creping, calendaring (optional), and reeling the web.

The stock preparation step of the ATMOS process is the same as that of a conventional or TAD machine. The forming process can utilize a twin wire former (as described in U.S. Pat. No. 7,744,726), a Crescent Former with a suction Forming Roll (as described in U.S. Pat. No. 6,821,391), or a Crescent Former (as described in U.S. Pat. No. 7,387,706). The former is provided with a slurry from the headbox to a nip formed by a structured fabric (inner position/in contact with the forming roll) and forming fabric (outer position). The fibers from the slurry are predominately collected in the valleys (or pockets, pillows) of the structured fabric and the web is dewatered through the forming fabric. This method for forming the web results in a bulk structure and surface topography as described in U.S. Pat. No. 7,387,706 (FIGS. 1-11). After the forming roll, the structured and forming fabrics separate, with the web remaining in contact with the structured fabric.

The web is then transported on the structured fabric to a belt press. The belt press can have multiple configurations. The press dewaters the web while protecting the areas of the sheet within the structured fabric valleys from compaction. Moisture is pressed out of the web, through the dewatering fabric, and into the vacuum roll. The press belt is permeable and allows for air to pass through the belt, web, and dewatering fabric, and into the vacuum roll, thereby enhancing the moisture removal. Since both the belt and dewatering fabric are permeable, a hot air hood can be placed inside of the belt press to further enhance moisture removal. Alternately, the belt press can have a pressing device which includes several press shoes, with individual actuators to control cross direction moisture profile, or a press roll. A common arrangement of the belt press has the web pressed against a permeable dewatering fabric across a vacuum roll by a permeable extended nip belt press. Inside the belt press is a hot air hood that includes a steam shower to enhance moisture removal. The hot air hood apparatus over the belt press can be made more energy efficient by reusing a portion of heated exhaust air from the Yankee air cap or recirculating a portion of the exhaust air from the hot air apparatus itself.

After the belt press, a second press is used to nip the web between the structured fabric and dewatering felt by one hard and one soft roll. The press roll under the dewatering fabric can be supplied with vacuum to further assist water removal. This belt press arrangement is described in U.S. Pat. Nos. 8,382,956 and 8,580,083, with FIG. 1 showing the arrangement. Rather than sending the web through a second press after the belt press, the web can travel through a boost dryer, a high pressure through air dryer, a two pass high pressure through air dryer or a vacuum box with hot air supply hood. U.S. Pat. Nos. 7,510,631, 7,686,923, 7,931,781, 8,075,739, and 8,092,652 further describe methods and systems for using a belt press and structured fabric to make tissue products each having variations in fabric designs, nip pressures, dwell times, etc. A wire turning roll can also be utilized with vacuum before the sheet is transferred to a steam heated cylinder via a pressure roll nip.

The sheet is then transferred to a steam heated cylinder via a press element. The press element can be a through drilled (bored) pressure roll, a through drilled (bored) and blind drilled (blind bored) pressure roll, or a shoe press. After the web leaves this press element and before it contacts the steam heated cylinder, the % solids are in the range of 40-50%. The steam heated cylinder is coated with chemistry to aid in sticking the sheet to the cylinder at the press element nip and also to aid in removal of the sheet at the doctor blade. The sheet is dried to up to 99% solids by the steam heated cylinder and an installed hot air impingement hood over the cylinder. This drying process, the coating of the cylinder with chemistry, and the removal of the web with doctoring is explained in U.S. Pat. Nos. 7,582,187 and 7,905,989. The doctoring of the sheet off the Yankee, i.e., creping, is similar to that of TAD with only the knuckle sections of the web being creped. Thus, the dominant surface topography is generated by the structured fabric, with the creping process having a much smaller effect on overall softness as compared to conventional dry crepe. The web is then calendared (optional), slit, reeled and ready for the converting process.

The ATMOS process has capital costs between that of a conventional tissue machine and a TAD machine. It uses more fabrics and a more complex drying system compared to a conventional machine, but uses less equipment than a TAD machine. The energy costs are also between that of a conventional and a TAD machine due to the energy efficient hot air hood and belt press. The productivity of the ATMOS machine has been limited due to the inability of the novel belt press and hood to fully dewater the web and poor web transfer to the Yankee dryer, likely driven by poor supported coating packages, the inability of the process to utilize structured fabric release chemistry, and the inability to utilize overlaid fabrics to increase web contact area to the dryer. Poor adhesion of the web to the Yankee dryer has resulted in poor creping and stretch development which contributes to sheet handling issues in the reel section. The result is that the output of an ATMOS machine is currently below that of conventional and TAD machines. The bulk softness and absorbency is superior to conventional, but lower than a TAD web since some compaction of the sheet occurs within the belt press, especially areas of the web not protected within the pockets of the fabric. Also, bulk is limited since there is no speed differential to help drive the web into the structured fabric as exists on a TAD machine. The surface smoothness of an ATMOS web is between that of a TAD web and a conventional web primarily due to the current limitation on use of overlaid structured fabrics.

The ATMOS manufacturing technique is often described as a hybrid technology because it utilizes a structured fabric like the TAD process, but also utilizes energy efficient means to dewater the sheet like the conventional dry crepe process. Other manufacturing techniques which employ the use of a structured fabric along with an energy efficient dewatering process are the ETAD process and NTT process. The ETAD process and products are described in U.S. Pat. Nos. 7,339,378, 7,442,278, and 7,494,563. The NTT process and products are described in WO 2009/061079 A1, United States Patent Application Publication No. 2011/0180223 A1, and United States Patent Application Publication No. 2010/0065234 A1. The QRT process is described in United States Patent Application Publication No. 2008/0156450 A1 and U.S. Pat. No. 7,811,418. A structuring belt manufacturing process used for the NTT, QRT, and ETAD imprinting process is described in U.S. Pat. No. 8,980,062 and United States Patent Application Publication No. US 2010/0236034.

The NTT fabric forming process involves spirally winding strips of polymeric material, such as industrial strapping or ribbon material, and adjoining the sides of the strips of material using ultrasonic, infrared, or laser welding techniques to produce an endless belt. Optionally, a filler or gap material can be placed between the strips of material and melted using the aforementioned welding techniques to join the strips of materials. The strips of polymeric material are produced by an extrusion process from any polymeric resin such as polyester, polyamide, polyurethane, polypropylene, or polyether ether ketone resins. The strip material can also be reinforced by incorporating monofilaments of polymeric material into the strips during the extrusion process or by laminating a layer of woven polymer monofilaments or felt layer to the non-sheet contacting surface of a finished endless belt composed of welded strip material. The endless belt can have a textured surface produced using processes such as sanding, graving, embossing, or etching. The belt can be impermeable to air and water, or made permeable by processes such as punching, drilling, or laser drilling. Examples of structuring belts used in the NTT process can be viewed in International Publication Number WO 2009/067079 A1 and United States Patent Application Publication No. 2010/0065234 A1.

As shown in the aforementioned discussion of tissue papermaking technologies, the fabrics or belts utilized are critical in the development of the tissue web structure and topography which, in turn, are instrumental in determining the quality characteristics of the web such as softness (bulk softness and surface smoothness) and absorbency. The manufacturing process for making these fabrics has been limited to weaving a fabric (primarily forming fabrics and structured fabrics) or a base structure and needling synthetic fibers (press fabrics) or overlaying a polymeric resin (overlaid structured fabrics) to the fabric/base structure, or welding strips of polymeric material together to form an endless belt.

Conventional overlaid structures require application of an uncured polymer resin over a woven substrate where the resin completely penetrates through the thickness of the woven structure. Certain areas of the resin are cured and other areas are uncured and washed away from the woven structure. This results in a fabric where airflow through the fabric is only possible in the Z-direction. Thus, in order for the web to dry efficiently, only highly permeable fabrics can be utilized, meaning the amount of overlaid resin applied needs to be limited. If a fabric of low permeability is produced in this manner, then drying efficiency is significantly reduced, resulting in poor energy efficiency and/or low production rates as the web must be transported slowly across the TAD drums or ATMOS drum for sufficient drying. Similarly, a welded polymer structuring layer is extremely planar and provides an even surface when laminating to a woven support layer, which results in no air channels in the X-Y plane.

As described in U.S. Pat. No. 10,208,426 B2, fabrics comprised of extruded polymer netting laminated to a woven structure utilize less energy to dry the sheet compared to prior designs. Both the extruded polymer netting layer and woven layer have non-planar, irregularly shaped surfaces that when laminated together only weld together where the two layers come into direct contact. This creates air channels in the X-Y plane of the fabric through which air can travel when the sheet is being dried with hot air in the TAD, UCTAD, or ATMOS processes. Without being bound by theory, it is likely that the airflow path and dwell time is longer through this type of fabric, allowing the air to remove higher amounts of water compared to prior designs. Prior woven and overlaid designs create channels where airflow is channeled in the Z-direction by the physical restrictions imposed by the monofilaments or polymers of the belt that create the pocket boundaries of the belt. The polymer netting/woven structure design allows for less restricted airflow in the X-Y plane such that airflow can move parallel through the belt and web across multiple pocket boundaries and thereby increase contact time of the airflow within the web to remove additional water. This allows for the use of lower permeable belts compared to prior fabrics without increasing the energy demand per ton of paper dried. The air flow in the X-Y plane also reduces high velocity air flow in the Z-direction as the sheet and fabric pass across the molding box, reducing the occurrence of pin holes in the sheet. Additional information on laminated composite fabric can be found in U.S. Pat. Nos. 10,415,185, 10,815,620, 10,787,767, 11,028,534, and U.S. Patent Application Publication No. US2021/0078284 A1 the contents of which are incorporated herein by reference in their entirety.

Additionally, a process for manufacturing a structuring fabric or the web contacting layer of a laminated structuring fabric by laying down polymers of specific material properties in an additive manner under computer control (3-D printing) has been described in U.S. Patent No. 10,099,425 and U.S Patent Application Publication No. US 2021-0071365 the contents of which are incorporated herein by reference in their entirety.

Cleaning of the types of structuring fabrics utilized on the various tissue machines mentioned are important in controlling machine productivity and paper quality. As the machine fabrics drain, imprint, and convey the paper web, they can become contaminated with components of the slurry used to make the paper web, such as cellulosic fibers and chemistry. Contamination can lead to lost productivity and/or poor product quality. For example, when a structuring fabric on a TAD paper machine is contaminated, the ability for air to flow through the web, structuring fabric and into the TAD drum is restricted. If the air flow is restricted, the web will not dry quickly and the machine will need to be slowed to increase dwell time across the TAD drum to enhance drying. Slowing of the machine will lead to lost productivity.

Oftentimes, a structuring fabric can be contaminated unevenly. This will lead to uneven web drying across the TAD drum. Differences in web moisture directly affect the quality parameters of the web, leading to variable web properties and poor quality.

Conventional methods for cleaning the structuring fabrics often include the application of so-called flooding showers and impact showers. Flooding showers apply a relatively high volume, low velocity water jet across the entire width of the inner (non-sheet contacting) side of a looped fabric to loosen and remove contaminants from the body or interstices of the fabric. Impact showers apply a relatively high velocity, low volume water jet to the entire width of a fabric to clean contaminants off the outer (sheet contacting) surface of the fabric. The two showers are often used together to provide optimal cleaning to both sides of a fabric. For example the impact shower first ejects a high velocity water jet to the outer surface of the fabric to dislodge the wood pulp fibers from the surface of the fabric, and then the flooding shower ejects high volume water jet to the inner surface of the fabric to flood the void space in the fabric with enough water to flush fiber from interstices of the fabric as well as the fiber on the surface of the fabric loosened by the impact shower.

A vacuum box that extends across the full width of the paper machine is often utilized after showering to dry the fabric and prevent rewet of the paper web as the looped fabric returns to conveying the paper web. This vacuum box is typically referred to as a uhle box. The box will also remove much of any remaining entrained cellulosic fibers or other contaminants.

There is a need for improved systems and methods for cleaning laminated structured fabrics.

SUMMARY OF THE INVENTION

It has been discovered that the uhle box can cause delamination of composite laminated fabrics when used to remove water and contaiminants from the sheet side of the fabric after showering. The frictional force and heat generated by the fabric moving quickly across the surface of a stationary uhle box begins to delaminate or peel away the nonwoven layer from the woven base fabric at any splices or seams that exist in the machine or cross machine direction of the fabric. Once delamination begins, holes can begin to appear in the paper web, where loose pieces of nonwoven polymer hang from the woven base layer, and the fabric must then be replaced, costing money and lost productivity.

An object of the present invention is to provide a system and method to prevent delamination or damage of composite imprinting fabrics used for tissue papermaking caused by using a stationary vacuum box, referred to as a uhle box, on the sheet side of the fabric.

Another object of the present invention is to provide a system and method of cleaning composite imprinting fabrics without the use of a uhle box in contact with the sheet side of the fabric.

In accordance with exemplary embodiments of the present invention, the uhle box is removed from the sheet side of the imprinting fabric and replaced with a vacuum roll. The vacuum roll is installed after the cleaning showers and in contact with the sheet side of the laminated composite imprinting fabric.

In exemplary embodiments, to reduce cost, the vacuum roll can replace a roll in the fabric run.

In exemplary embodiments, use of a rotating vacuum roll in place of a stationary uhle box can prevent fabric delamination of composite laminated imprinting fabrics. Other types of imprinting fabrics previously described would also benefit from use of a vacuum roll on the sheet side of the fabric to prevent the kind of frictional wear or heat damage caused by a stationary uhle box.

In exemplary embodiments, the vacuum box of the vacuum roll resides completely inside the contact zone between the vacuum roll and imprinting fabric and extends between 1 to 90 degrees along the circumference of the vacuum roll, more preferably 2 to 45 degrees or 2 to 30 degrees, and most preferably 2-20 degrees.

In exemplary embodiments, the vacuum pulled through the vacuum roll is between −5 to −100 kilopascals (kpa), more preferably −10 to −90 kpa, and most preferably −30 to −70 kpa.

In exemplary embodiments, the total air flow through a section of roughly one meter of the vacuum box is between 100-1000 cubic meters per min, more preferably 200-800 cubic meters per minute or 250-600 cubic meters per minute, most preferably 250-500 cubic meters per minute.

In accordance with exemplary embodiments of the present invention, a method of cleaning an imprinting fabric used in a papermaking process to make bath tissue, paper towel, or facial tissue comprises: washing the fabric with water from high pressure impact showers and flooding showers; and removing water remaining on the fabric after the step of washing with a vacuum roll on a sheet side of the imprinting fabric, the sheet side of the imprinting fabric being configured to be in direct contact with a paper web during the papermaking process.

In exemplary embodiments the pressure of the impact showers is between 10 to 50 bar, more preferably 20 to 40 bar.

In exemplary embodiments, the flow through each meter in length of the flooding shower is 200 to 800 liters per minute, more preferably 400 to 600 liters per minute.

In an exemplary embodiment, the method does not comprise removing water from the fabric with a uhle box on the sheet side of the imprinting fabric (i.e., the sheet side of the cleaning station in which the imprinting fabric is cleaned is devoid of a uhle box).

In an exemplary embodiment, the roll/on-sheet side of the fabric uses a uhle box in a cleaning station to clean the inside of the imprinting fabric and uses a single or double slot with each slot between 5 to 20 mm, more preferably 10 to 15 mm and pulls a vacuum of −20 to −60 kpa of vacuum, more preferably −30 to −50 kpa.

A structured fabric cleaning station in accordance with exemplary embodiments of the present invention comprises: at least one impact shower; at least one flooding shower; at least one uhle box disposed at a fabric side of an imprinting fabric; and at least one vacuum roll disposed at a nonwoven side of the imprinting fabric, wherein the cleaning station does not comprise a uhle box at the nonwoven side of the imprinting fabric (i.e., the cleaning station is devoid of a uhle box at the nonwoven side of the imprinting fabric).

BRIEF DESCRIPTION OF THE DRAWINGS

Exemplary embodiments of the present disclosure will be described with references to the accompanying figures, wherein.

DETAILED DESCRIPTION

Figure 1:
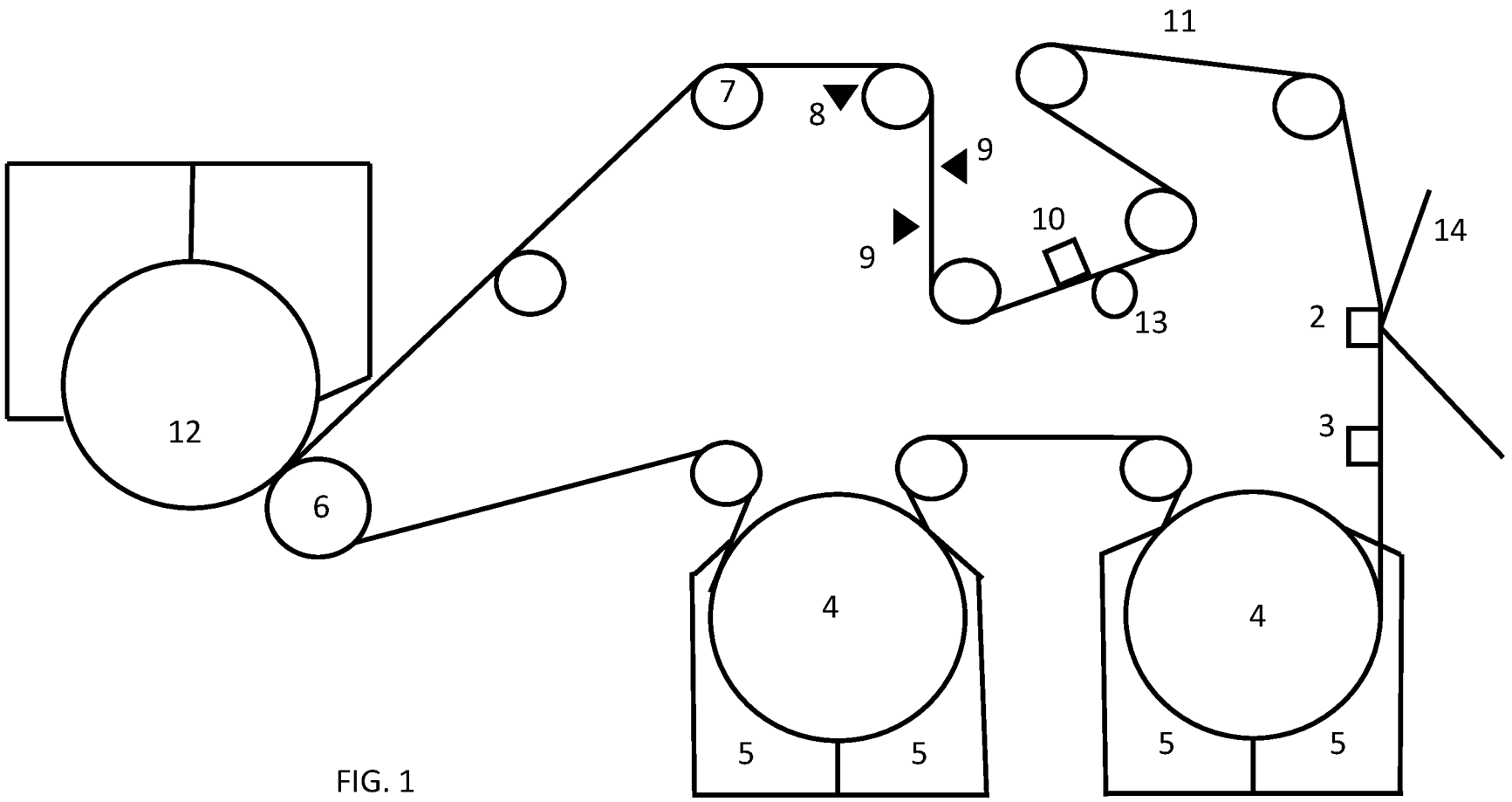
FIG. 1 is a block diagram of an imprinting section of a TAD machine in accordance with an exemplary embodiment of the present invention.

Bath tissue, paper towel, and facial tissue paper can be made using technologies that use imprinting fabrics to improve the quality of the paper product, for example by improving sheet caliper and softness. Maintaining the cleanliness of the imprinting fabric is important to maintain productivity of the paper machine and quality of the finished product. In order to maintain the cleanliness of the imprinting fabric, flooding and impact showers are utilized along with both sheet and non-sheet side (roll side) stationary uhle boxes. However, use of a stationary uhle box on the sheet side of a laminated composite imprinting fabric can cause delamination and failure of the overlaid imprinting fabric. Overlaid imprinted fabrics can be produced by many methods, but they all involve adding polymer elements on the surface of a belt or fabric to create patterns in the paper. The overlaid fabric can be produced by laminating two sheets of materials or printing polymer on top of a woven or nonwoven carrier fabric. In addition to lamintation, screen printing or nozzle printing can also be used.

In accordance with exemplary embodiments of systems and methods of the present invention, a vacuum roll rather than a uhle box is used on the sheet side of the fabric after the cleaning showers. This configuration removes the excess water and any remaining fibers from the fabric without any damage to the fabric itself. Conventional cleaning stations do not use a vacuum roll on a sheet side of a structured fabric.

A vacuum roll in accordance with an exemplary embodiment of the present invention may include an external shell with holes and/grooves formed completely through the shell. The external shell may be made of materials, such as, for example, metal, rubber, polyurethane, metal wire mesh and combinations thereof, to name a few. A stationary vacuum box may be disposed within the shell. The shell has a contact zone in which the shell is in contact with the impring fabric. The vacuum box resides completely inside the contact zone and extends between 1 to 90 degrees along the circumference of the vacuum roll, more preferably 2 to 45 degrees or 2-30 degrees, and most preferably 2-20 degrees. Seals may be disposed at the border of the contact zone. A vacuum system is used to remove water, entrained air, cellulosic fibers, chemistry and other material in the fabric through the vacuum box of the vacuum roll. The vacuum system may include components, such as, for example, a centrifugal pump or blower, piping and a separator, to name a few. The vacuum pulled through the vacuum roll is between −5 to −100 kilopascals (kpa), more preferably −10 to −90 kpa, and most preferably −30 to −70 kpa. The total air flow through a section of roughly one meter of the vacuum box is between 100-1000 cubic meters per min, more preferably 200-800 cubic meters per minute or 250-600 cubic meters per minute, most preferably 250-500 cubic meters per minute. Vacuum rolls are available through The Voith Group (Heidenheim, Germany), Andtriz AG (Graz, Austria), and Valmet (Espoo, Finland).

FIG. 1 shows an imprinting section of a TAD machine accordance to an exemplary embodiment of the present invention. The imprinting fabric 11 receives the paper web from a forming fabric 14 at a second transfer vacuum box 2. The web travels on the imprinting fabric 11 across a moulding box 3 and through two TAD drums 4 with air impingement hoods 5 before being transferred to the Yankee dryer 12 at the pressure roll 6. The imprinting fabric 11 then travels across a guide roll 7 into a cleaning station that uses a flooded nip shower 8 and a sheet and non sheet side impact shower 9. Excess water is removed using a non sheet side uhle box 10 and a sheet side vacuum roll 13. The non sheet side uhle box can have a single or double slot with each slot between 5 to 20 mm, more preferably 10 to 15 mm and pulls a vacuum of −20 to −60 kpa of vacuum, more preferably −30 to −50 kpa. The preferred pressure of the impact showers 9 is between 10 to 50 bar, more preferably 20 to 40 bar. The preferred flow through each meter of the flooding shower 8 is 60 to 160 gallons per minute, more preferably 80 to 150 gallons per minute.

Figure 2:
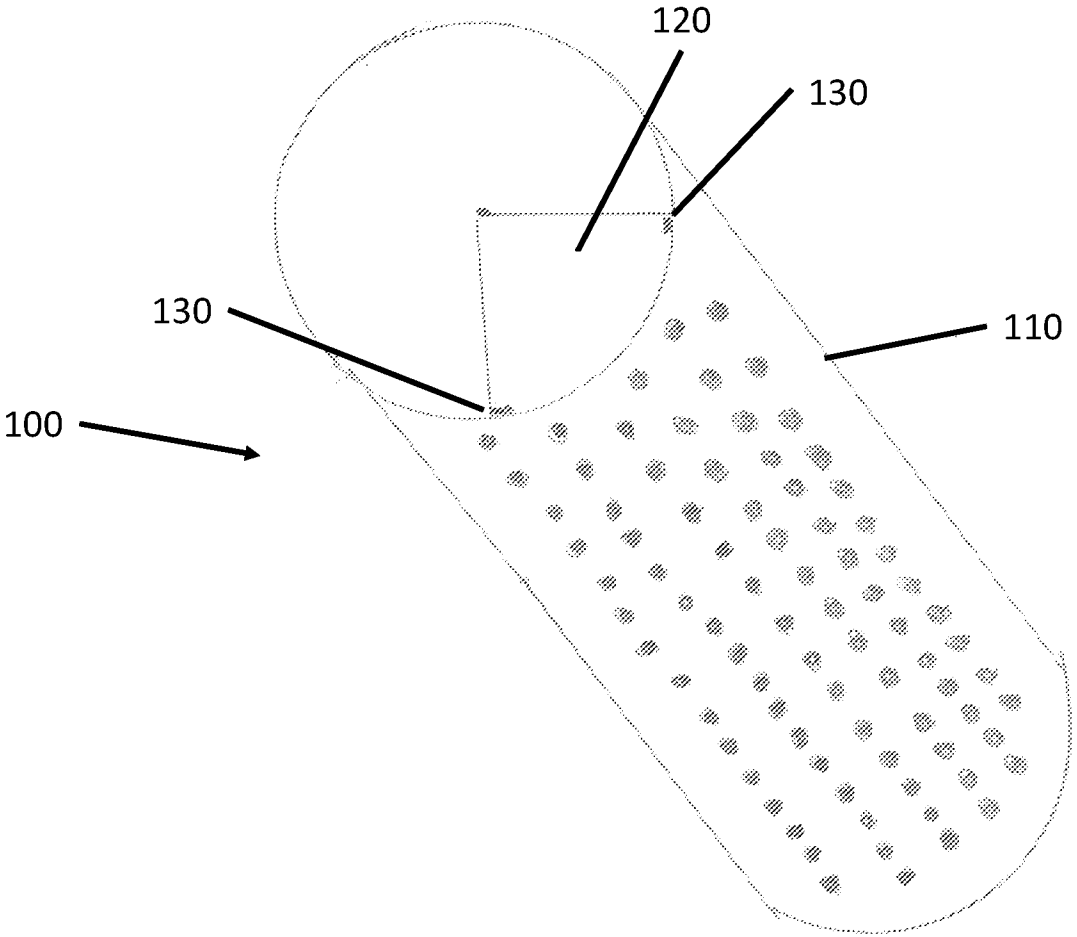
FIG. 2 is a perspective view of a vacuum roll according to an exemplary embodiment of the present invention.

FIG. 2 shows a vacuum roll, generally designated by reference number 100, according to an exemplary embodiment of the present invention. As previously described, the vacuum roll 100 includes a perforated outer shell 110 and a vacuum box 120 disposed within the outer shell 110. The vacuum box 120 resides completely inside the contact zone of the outer shell 110 and extends between 1 to 90 degrees along the circumference of the vacuum roll 100, more preferably 2 to 45 degrees or 2-30 degrees, and most preferablly 2-20 degrees. Seals 130 may be disposed at the border of the contact zone.

EXAMPLES

Example 1

A laminated composite imprinting fabric, P10SM TPU 30×9, was provided having a web contacting layer with the following characteristics and geometries: extruded netting with MD strands of 0.26 mm width×CD strands of 0.46 mm width, with a mesh of 30 MD strands per inch and a count of 9 CD strands per inch, % contact area of 26% with solely MD strands in plane in static measurement and then with 48% contact area under load as the structure compressed and the CD ribs moved into the same plane as the MD strands, due to use of the thermoplastic polyurethane ("TPU") elastomeric material. The TPU material is a softer material and measured in the range of 65 to 75 Shore A Hardness while the woven supporting layer comprised of harder polyethylene terephthalate ("PET") measured 95 to 105 Shore A Hardness using a portable Shore A Durometer test device calibrated per ASTM D 2240, the Mitutoyo Hardmatic HH-300 series, ASTD. The distance between MD elements in the web contacting layer was 0.60 mm, and the distance between the CD elements was 2.25 mm. The overall pocket depth was equal to the thickness of the TPU netting, which was equal to 0.50 mm. The pocket depth from the top surface of the netting to the CD mid-rib element was 0.25 mm. The TPU netting was a natural color, the permeability of the TPU laminated belt was 410 cubic feet per minute ("CFM") and the laminated belt had a caliper of 0.99 mm. The peel force required to remove the web contacting layer from the woven supporting layer was 1400 grams per foot and the shear number was 225. The embedment distance was 0.14 mm. The supporting layer had a 0.27×0.22 mm cross-section rectangular MD yarn at 56 yarns/inch, and a 0.35 mm CD yarn at 41 yarns/inch. The weave pattern of the base layer was a 5-shed, 1 MD yarn over 4 CD yarns, then under 1 CD yarn, then repeated. The material of the base fabric yarns was 100% PET, and the yarns were transparent. The fabric was sanded at 25% contact area, with an air permeability of 675 CFM. The weft yarns received 0.40% carbon black content by weight in the CD, and the warp yarns received 0.14% carbon black content by weight in the MD. The base fabric and a Mylar protective cover fabric were not placed under any tension during the production process. Mylar, also known as BoPET (Biaxially-oriented polyethylene terephthalate) is a polyester film made from stretched polyethylene terephthalate (PET) and is used for its high tensile strength, and chemical and dimensional stability. Other films can be used if they are non-stick and they are able to maintain dimensional stability. Suitable other non-stick films include polytetrafluorethylene (TEFLON), silicone treated films and the like. By non-stick is meant having a surface energy between about 10 mj/m$^2$ to about 200 mj/m$^2$. The TPU netting was placed under 0.50 PLI of tension during production. The welding laser was set to 40% power level (161 watts), at a welding head speed of 50 mm/sec and an optical line width of 34 mm with a 1 mm overlap between laser passes (line energy was set to 3200 J/m).

The composite belt was used on a TAD machine using a specific furnish recipe and paper machine running conditions, as follows:

Two webs of through air dried tissue were laminated to produce a roll of 2-ply sanitary (bath) tissue. Each tissue web was multilayered with the fiber and chemistry of each layer selected and prepared individually to maximize product quality attributes of softness and strength. The first exterior layer, which was the layer that contacted the Yankee dryer, was prepared using 100% eucalyptus with 1.375 kg/ton of the amphoteric starch, Redibond 2038 (Corn Products, 10 Finderne Avenue, Bridgewater, New Jersey 08807). The interior layer was composed of 50% northern bleached softwood kraft fibers, 50% eucalyptus fibers, and 1.5 kg/ton of T526, a softener/debonder (EKA Chemicals Inc., 1775 West Oak Commons Court, Marietta, GA, 30062) and 2.0 kg/ton of Hercobond 1194 glyoxylated polyacrylamide (Ashland, 500 Hercules Road, Wilmington DE, 19808). The second exterior layer was composed of 50% northern bleached softwood kraft fibers, 50% eucalyptus fibers and 4.125 kg/ton of Redibond 2038 and 2.0 kg/ton of Hercobond 1194.

All the softwood fibers were refined at 30 kwh/ton to impart the necessary tensile strength.

The fiber and chemicals mixtures were diluted to solids of 0.5% consistency and fed to separate fan pumps, which delivered the slurry to a triple layered headbox. The headbox pH was controlled to 7.0 by addition of a caustic to the thick stock that was fed to the fan pumps. The headbox deposited the slurry to a nip formed by a forming roll, an outer forming wire, and inner forming wire. When the fabrics separated, the web followed the inner forming wire and dried to approximately 25% solids using a series of vacuum boxes and a steam box.

The web was then transferred to the laminated composite fabric with the aid of a vacuum box to facilitate fiber penetration into the fabric to enhance bulk softness and web imprinting. The web was dried with the aid of two TAD hot air impingement drums to approximately 82% solids before being transferred to the Yankee dryer.

The web was held in intimate contact with the Yankee drum surface running at 1100 m/min using an adhesive coating chemistry. The Yankee dryer was provided with steam at 4.5 bar with a installed hot air impingement hood over the Yankee dryer. In accordance with an exemplary embodiment of the present invention, the web was creped from the yankee dryer at 15% crepe (speed differential between the Yankee dryer and reel drum) at approximately 96.0% solids. The web was was reeled into two equally sized parent rolls and transported to the converting process.

After the sheet transferred to the Yankee dryer, the laminated composite imprinting fabric proceeded to the cleaning station comprising a flooding shower, a sheet side and roll side impact fan shower, a sheet side vacuum roll, and a roll side uhle box. The fan showers were operating at 30 bar, the flooded nip shower was using 530 liters mer minute per meter length of the shower, the roll side (non-sheet side) uhle box with two 12.5 mm slots was operating at 34 kpa, and the vacuum roll with roughly a 7.5 degree vacuum box and a perforated brass shell at 67% open area was operating at a vacuum of −45 kpa with an air flow of approximately 325 cubic meters per minute.

The imprinting fabric was cleaned in the cleaning station with no productivity issues related to fabric cleanliness and no delamination of the imprinting fabric.

Now that embodiments of the present invention have been shown and described in detail, various modifications and improvements thereon can become readily apparent to those skilled in the art. Accordingly, the exemplary embodiments of the present invention, as set forth above, are intended to be illustrative, not limiting. The spirit and scope of the present invention is to be construed broadly.

We claim:

1. A method of cleaning an imprinting fabric used in a papermaking process to make bath tissue, paper towel, or facial tissue, comprising: washing the imprinting fabric with water from high pressure impact showers and flooding showers; and removing water remaining on the imprinting fabric after the step of washing with a vacuum roll having an external shell with holes and/or grooves formed completely through the shell on a sheet side of the imprinting fabric so as to remove the excess water and any remaining fibers from the fabric without any damage to the imprinting fabric itself, the sheet side of the imprinting fabric being configured to be in direct contact with a paper web during the papermaking process and wherein vacuum box resides completely inside a contact zone between the vacuum roll and imprinting fabric and extends between 1 to 90 degrees along a circumference of the vacuum roll.

2. The method of claim 1, wherein the vacuum roll comprises a metal wire mesh, rubber, or polyurethane material shell with an internal stationary vacuum box.

3. The method of claim 1, further comprising removing water remaining on the imprinting fabric with a uhle box on a woven side of the imprinting fabric that is opposite to the sheet side.

4. The method of claim 1, wherein the method does not comprise removing water from the fabric with a uhle box on the sheet side of the imprinting fabric.

5. The method of claim 1, wherein vacuum pulled through the vacuum roll is between −5 to −100 kilopascals.

6. The method of claim 1, wherein total air flow through a section of roughly one meter of a vacuum box is between 100-1000 cubic meters per minute.

7. A structured fabric cleaning station comprising:

at least one impact shower;

at least one flooding shower;

at least one uhle box disposed at a fabric side of an imprinting fabric; and at least one vacuum roll disposed at a nonwoven side of the imprinting fabric, the at least one vacuum roll having an external shell with holes and/or grooves formed completely through the shell, so as to remove excess water and any remaining fibers from the imprinting fabric without any damage to the imprinting fabric itself, a vacuum box of the vacuum roll residing completely inside a contact zone between the vacuum roll and imprinting fabric and extending between 1 to 90 degrees along a circumference of the vacuum roll, wherein the cleaning station does not comprise a uhle box at the nonwoven side of the imprinting fabric.

8. The structured fabric cleaning station of claim 7, wherein the vacuum roll comprises a metal wire mesh, rubber, or polyurethane material shell with an internal stationary vacuum box.

9. The structured fabric cleaning station of claim 7, wherein a vacuum box resides completely inside a contact zone between the vacuum roll and imprinting fabric and extends between 1 to 90 degrees along a circumference of the vacuum roll.

* * * * *